US006615447B2

(12) United States Patent
Rew

(10) Patent No.: US 6,615,447 B2
(45) Date of Patent: Sep. 9, 2003

(54) VACUUM CLEANER

(75) Inventor: Ho Seon Rew, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/987,471

(22) Filed: Nov. 14, 2001

(65) Prior Publication Data

US 2002/0066155 A1 Jun. 6, 2002

(30) Foreign Application Priority Data

Dec. 1, 2000 (KR) ..... 2000-72497

(51) Int. Cl.[7] ..... A47L 5/00; A47L 5/36
(52) U.S. Cl. ..... 15/412; 15/327.2; 15/409
(58) Field of Search ..... 15/327.1, 327.2, 15/327.6, 327.7, 331, 347, 377, 409, 412

(56) References Cited

U.S. PATENT DOCUMENTS 2,997,728 A * 8/1961 Gaudry ..... 15/323
3,444,584 A * 5/1969 Cotte ..... 15/344
3,452,751 A * 7/1969 Austin, Jr. ..... 604/149

FOREIGN PATENT DOCUMENTS

JP 10-155707 * 6/1998

* cited by examiner

*Primary Examiner*—Terrence R. Till
(74) *Attorney, Agent, or Firm*—Birch, Stewart, Kolasch & Birch, LLP

(57) ABSTRACT

A vacuum cleaner includes a case having a collection chamber including a filter for removing extraneous matter mixed with air sucked in through main suction channels and an apparatus chamber including a fan motor assembly for generating suction force and discharging intake air behind the collection chamber and a peripheral air suction unit connected between the external surface of the case and the main suction channels or between the external surface of the case and the inside of the collection chamber in addition to the main suction channels, the peripheral air suction unit sucking up the air around the case. It is possible to suck up dust that floats in the air around the vacuum cleaner, caused by air discharged when the vacuum cleaner is used and to purify the air. Accordingly, it is possible to reduce the inconvenience of a user and to improve cleaning efficiency.

13 Claims, 4 Drawing Sheets

VACUUM CLEANER

This nonprovisional application claims priority under 35 U.S.C. §119(a) on Patent Application No. 72497/2000 filed in Korea on Dec. 1, 2000, which is herein incorporated by reference.

BACKGROUND OF THE INVENTION

1. Field of the Invention

The present invention relates to a vacuum cleaner, and more particularly, to a vacuum cleaner for sucking up dust that floats in the air around the vacuum cleaner, caused by air discharged when the vacuum cleaner is used, and purifying the air.

2. Description of the Conventional Art

In general, a vacuum cleaner is an apparatus for collecting extraneous matter such as dust by a strong suction force generated by the operation of a fan motor assembly, thus performing cleaning.

FIG. 1 is a side view showing a conventional vacuum cleaner, and FIG. 2 is a sectional view taken along the line II—II of FIG. 1.

In the conventional vacuum cleaner shown in FIG. 1, a suction head 2, an extension pipe 3, and a suction hose 5 are sequentially connected to a case 10 so that extraneous matter such as dust can be sucked in from the outside A pair of wheels 7 are installed on both sides of the case 10 so that a user can easily move the vacuum cleaner.

As shown in FIG. 2, a collection chamber 11 that includes a dust filter bag 20, which collects extraneous matter such as dust, which is mixed with intake air, is located in the front part of the case 10. An apparatus chamber 13 that includes a fan motor assembly 30 which creates the suction force, and a cord chamber 14 in which a power cord 41 is wound, are located behind the collection chamber 11 such that the apparatus chamber 13 and the cord chamber 14 are separated from each other.

The collection chamber 11, the apparatus chamber 13, and the cord chamber 14 are separated from each other by partitions 10*a*, 10*b*, and 10*c*. A suction hole 12 is formed in the partition 10*a* between the collection chamber 11 and the apparatus chamber 13 so that air passing through the dust filter bag 20 can move toward the apparatus chamber 13.

Discharge channels 13*a* and 14*a* are respectively formed in the case 10 at the hind parts of the apparatus chamber 13 and the cord chamber 14 so that air discharged form the fan motor assembly 30 can be discharged to the outside of the case 10.

In the conventional vacuum cleaner that has the above structure, when the fan motor assembly 30 in the apparatus chamber 13 operates, extraneous matter such as dust included in outside air is sucked into the dust filter bag 20 through the suction head 2, the extension pipe 3, and the suction hose 5, by a suction force drawing air into the collection chamber 11 toward the apparatus chamber 13.

The air entering the dust filter bag 20 moves toward the apparatus chamber 13 by the continuous suction of the fan motor assembly 30. At this time, the extraneous matter such as dust, which is included in the air, is caught by the dust filter bag 20 to thus remain in the dust filter bag 20. The air that passes through the dust filter bag 20 is sucked toward the apparatus chamber 13 and is discharged to the outside of the case 10 through the discharge channels 13*a* and 14*a*.

However, the conventional vacuum cleaner disturbs dust around the vacuum cleaner when the air filtered while passing through the dust filter bag 20 is discharged to the outside of the case 10 through the discharge channels 13*a* and 14*a*. Therefore, the user of the vacuum cleaner is considerably inconvenienced and cleaning efficiency deteriorates.

That is, when the vacuum cleaner is operated, filtered air is strongly discharged from the hind part of the vacuum cleaner disturbing air around the vacuum cleaner and causing dust and other extraneous matter spread over the floor and to float in the air. Therefore, the user of the vacuum cleaner and people around the vacuum cleaner are considerably inconvenienced.

Also, the disturbed extraneous matter such as dust can settle down on the floor again after cleaning is finished, thus deteriorating cleaning efficiency.

SUMMARY OF THE INVENTION

It is an object of the present invention to provide a vacuum cleaner for sucking up the dust that floats in the air around the vacuum cleaner, caused by air discharged when the vacuum cleaner is used, into a case, and purifying thus air, to thus reduce the inconvenience of a user and to improve cleaning efficiency.

To achieve the above object, there is provided a vacuum cleaner, including a case having a collection chamber including a filter for removing extraneous matter mixed with air sucked in through main suction channels and an apparatus chamber including a fan motor assembly for generating suction force and discharging intake air behind the collection chamber and a peripheral air suction device connected between the external surface of the case and the main suction channels or between the external surface of the case and the inside of the collection chamber in addition to the main suction channels, the peripheral air suction device for sucking up the air around the case.

The vacuum cleaner further includes an ejector connected between the discharge area of the fan motor assembly and the inside of the peripheral air suction device, for ejecting some of the air discharged from the fan motor assembly into the peripheral air suction device.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE PREFERRED EMBODIMENT

Hereinafter, an embodiment of a vacuum cleaner according to the present invention will be described with reference to the accompanying drawings.

The vacuum cleaner according to the present invention may be embodied in a plurality of forms. However, a preferred embodiment of the vacuum cleaner according to the present invention will now be described.

Figure 1:
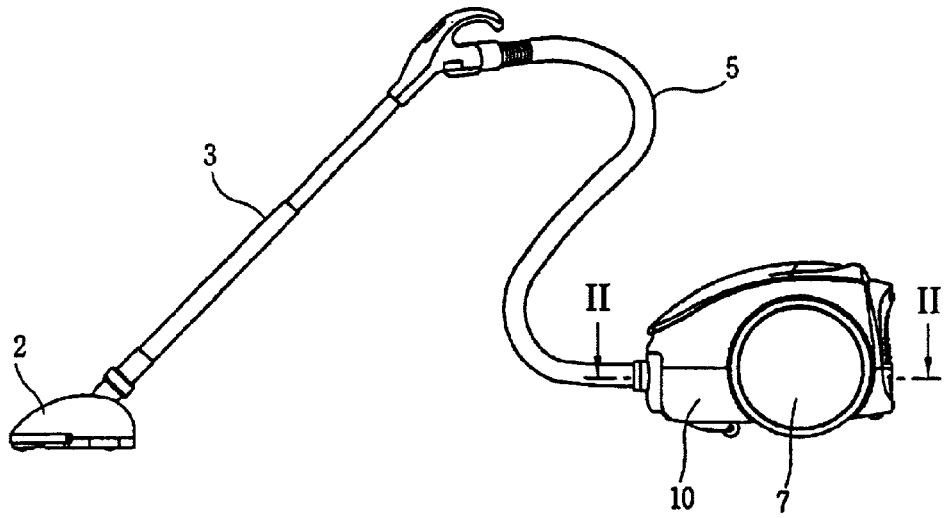
FIG. 1 CONVENTIONAL ART
FIG. 1 is a side view showing a conventional vacuum cleaner.
Figure 2:
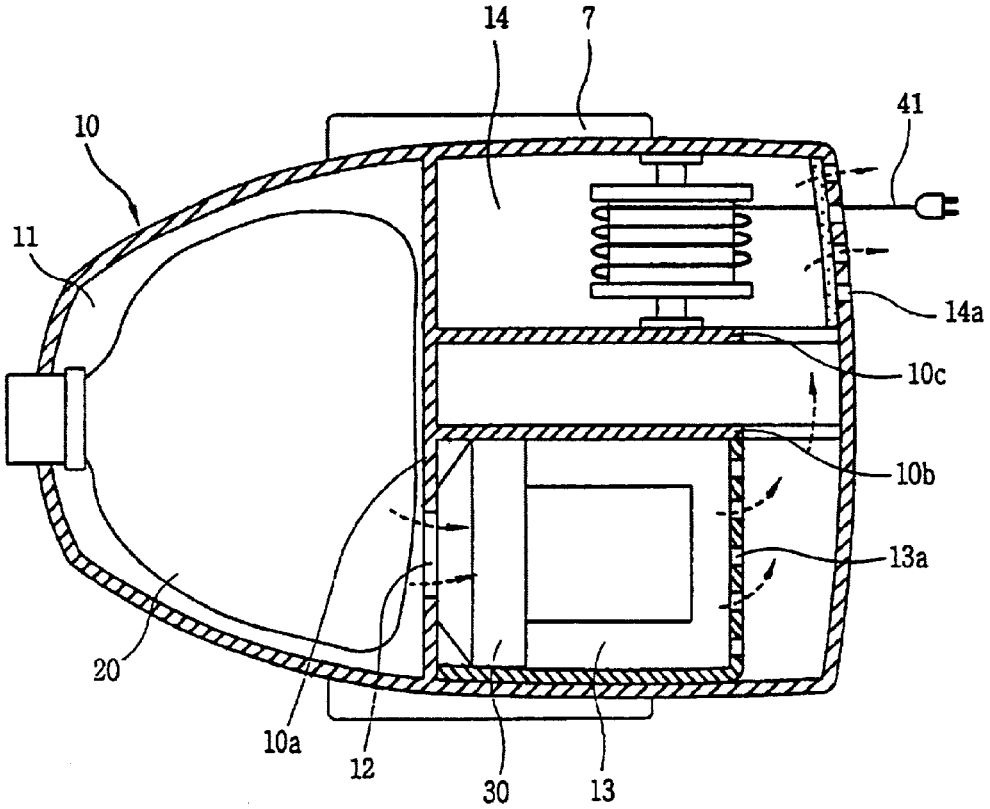
FIG. 2 CONVENTIONAL ART
FIG. 2 is a cross-sectional view of the vacuum cleaner taken along the line II—II in FIG. 1.
Figure 3:
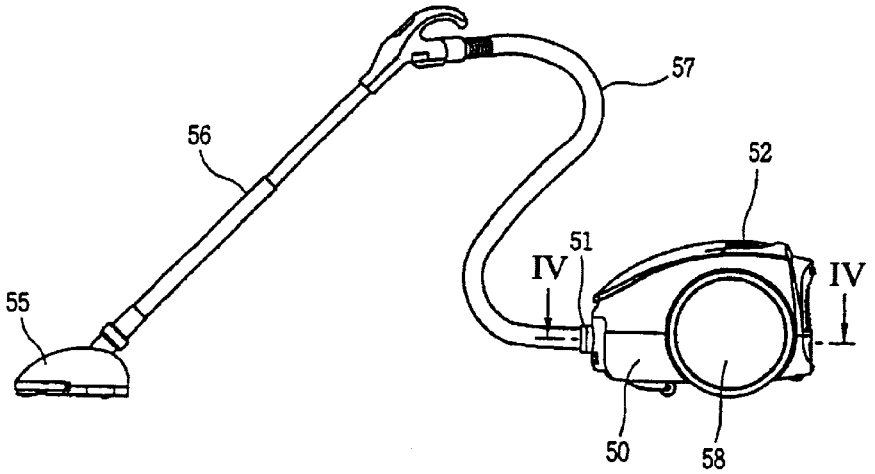
FIG. 3 is a side view of a vacuum cleaner that includes a peripheral air purifying apparatus according to the present invention.
Figure 4:
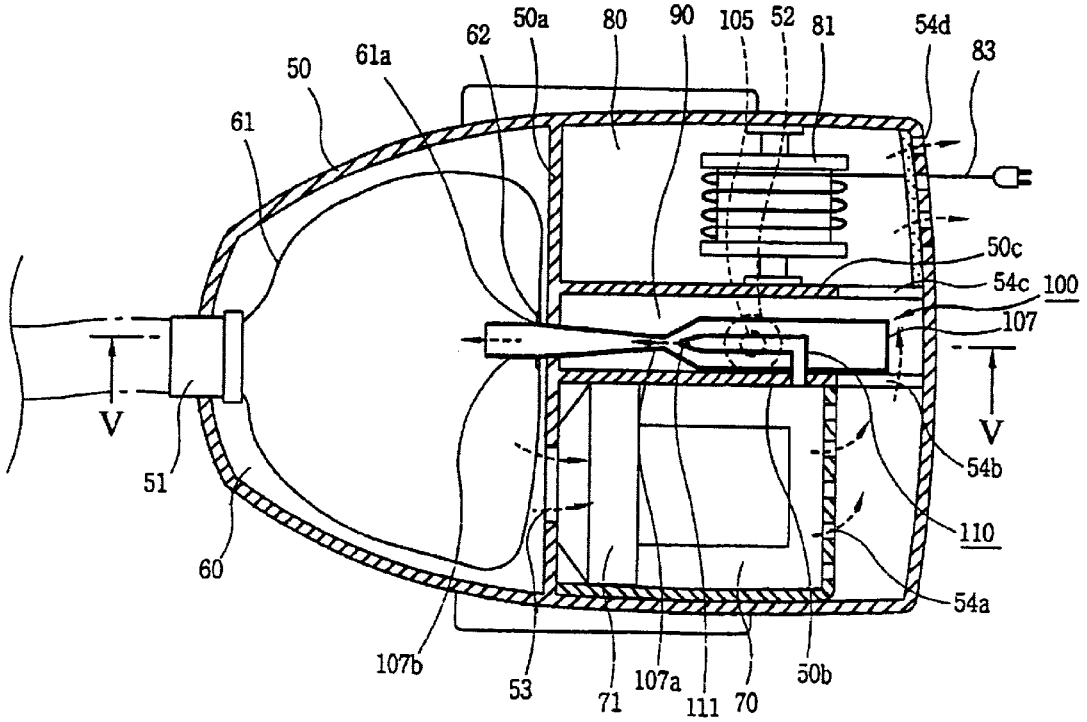
FIG. 4 is a cross-sectional view of the vacuum cleaner that includes a peripheral air purifying apparatus according to the present invention, taken along the line IV—IV in FIG. 3.
Figure 5:
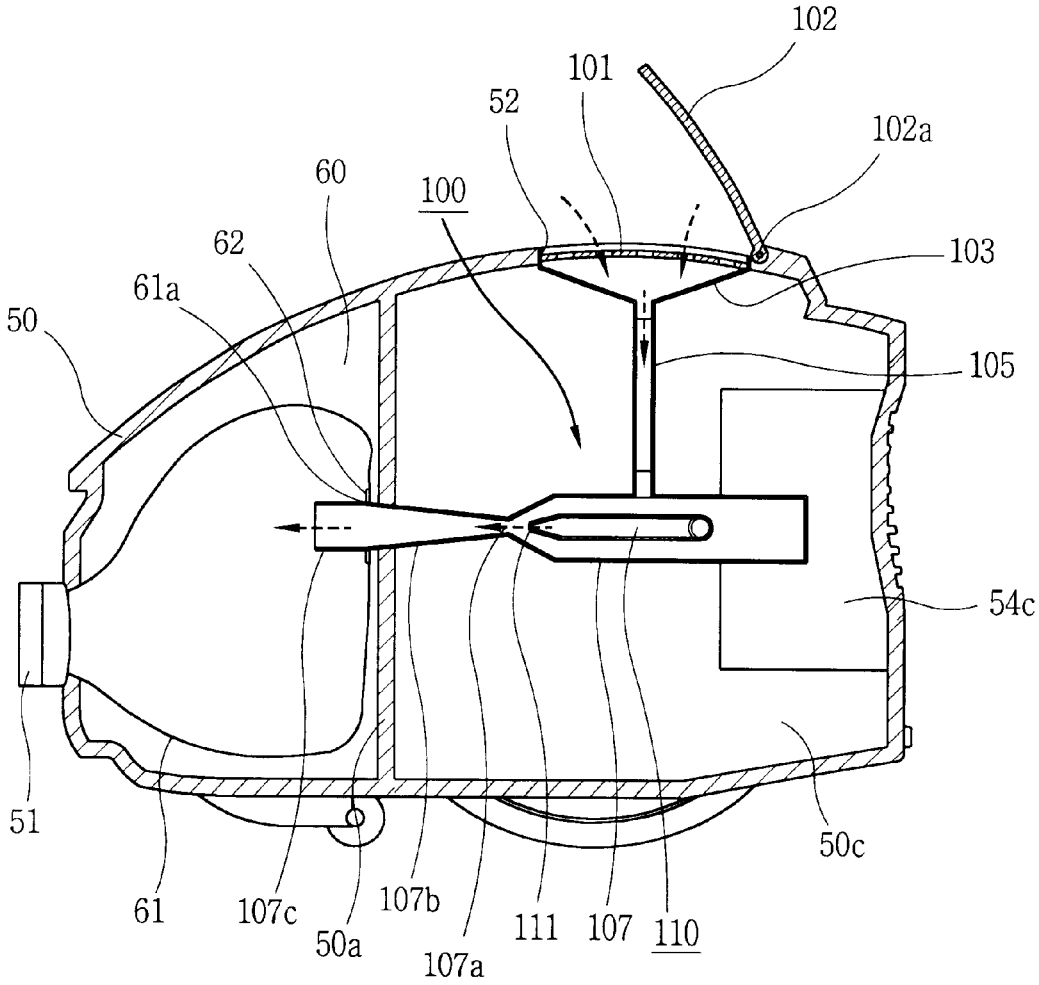
FIG. 5 is a vertical sectional view of the vacuum cleaner that includes a peripheral air purifying apparatus according to the present invention, taken along the line V—V in FIG. 4.

FIG. 3 is a side view of a vacuum cleaner that includes a peripheral air purifying apparatus according to the present invention, FIG. 4 is a sectional view taken along the line IV—IV in FIG. 3, and FIG. 5 is a sectional view taken along the line V—V in FIG. 4.

In the vacuum cleaner according to the present invention, as shown in FIG. 3, a first suction port 51 is located in the front part of a case 50, and a second suction port 52 is located on the top of the case 50 to suck up the air around the vacuum cleaner.

Main suction channels consisting of a suction head 55, an extension pipe 56, and a suction hose 57 are connected to the first suction port 51 of the case 50 to suck up extraneous matter in an area to be cleaned.

Wheels 58 are installed on both sides of the case 50 so that the vacuum cleaner can be easily moved.

In the vacuum cleaner, as shown in FIG. 4, a collection chamber 60, an apparatus chamber 70, a cord chamber 80, and a central chamber 90 are formed in the case 50 separated from each other by respective partitions 50*a*, 50*b*, and 50*c*.

That is, the collection chamber 60 is located in the front part of the case 50 and includes a dust filter bag 61 communicated with the first suction port 51 to thus collect extraneous matter such as dust, which is mixed with intake air.

The apparatus chamber 70 and the cord chamber 80 behind the collection chamber 60 are separated from each other by the central chamber 90 defined between the two partitions 50*b* and 50*c*.

The apparatus chamber 70 includes a fan motor assembly 71, which generates the suction force. The cord chamber 80 includes a cord wheel 81, around which a power cord 83 is wound.

A suction port 53 is formed in the partition 50*a* between the collection chamber 60 and the apparatus chamber 70 so that air passing through the dust filter bag 61 can flow toward the apparatus chamber 70.

Discharge channels 54*a*, 54*b*, 54*c*, and 54*d* are respectively formed in the hind part of the apparatus chamber 70, the partitions 50*b* and 50*c* on both sides of the central chamber 90, and the hind part of the cord chamber 80, so that air discharged from the fan motor assembly 71 can be discharged to the outside of the case 50.

The central chamber 90 includes a peripheral air suction device 100, which is located between the two partitions 50*b* and 50*c*, for sucking up dust that floats in the air around the vacuum cleaner during cleaning and for purifying the air.

The peripheral air suction device 100 is connected between the second suction port 52 and the collection chamber 60 so that air around the case 50 can be sucked up by subatmospheric pressure formed in the collection chamber 60, as shown in FIG. 5.

The peripheral air suction device 100 includes a vertical suction pipe 105 connected to the second suction port 52 on the top of the case 50 and extending into the case 50, and a horizontal suction pipe 107 connected to the lower end of the vertical suction pipe 105 and extending into the collection chamber 60.

A suction net 101 is installed in the second suction port 52 to prevent extraneous matter larger than a certain size from entering the case 50. A cone-shaped suction guide 103 is installed between the second suction port 52 and the vertical suction pipe 105.

An ejector pipe 110 is connected to the horizontal suction pipe 107 so that high-pressure discharge air can flow in from the apparatus chamber 70. A nozzle 111, which is located in the middle of the horizontal suction pipe 107, is formed in the end of the ejector pipe 110.

An orifice 107*a*, in which the diameter of the horizontal suction pipe 107 becomes smaller in the portion where the nozzle 111 of the ejector pipe 110 is located, is formed in the horizontal suction pipe 107, for increasing the velocity of airflow.

This is for minimizing the external pressure when high-pressure air is ejected from the ejector pipe 110 at high speed, thus increasing the suction force of the peripheral air suction device 100.

The ejector pipe 110 passes through the partition 50*b* between the apparatus chamber 70 and the central chamber 90 and the horizontal suction pipe 107 and is connected to the orifice 107*a*, as shown in FIG. 4.

Therefore, the ejector pipe 110 ejects the high-pressure air discharged to the apparatus chamber 70 through the fan motor assembly 71 into the horizontal suction pipe 107 through the nozzle 111, to thus augment the suction force by which the air around the case 50 is sucked into the collection chamber 60 through the peripheral air suction device 100.

An cover 102 for opening and closing the peripheral air suction device 100 can be installed above the suction net 101 in the peripheral air suction device 100.

The cover 102 is connected to the case 50 by a hinge 102*a* and can be opened or closed by a user, to thus suck in the air around the vacuum cleaner or not to suck in the air around the vacuum cleaner.

The area of the channel of the peripheral air suction device 100 is preferably formed to be smaller than the areas of main suction channels, to which the first suction port 51, the suction head 55, the extension pipe 56, and the suction hose 57 are connected.

This is so that most of the suction force formed by the operation of the fan motor assembly 71 goes to smoothly sucking up the extraneous matter in the area to be cleaned, in which the suction head 55 is located. Also, the dust particles floating in the air around the case 50 are relatively small and light and can be easily sucked in by a small suction force.

In the present embodiment, the inner diameter of the vertical suction pipe 105 is formed to be smaller than the inner diameter of the first suction port 51, as shown in FIG. 5.

The horizontal suction pipe 107 includes an extension pipe 107*b*, in which the area of the channel is gradually enlarged from the orifice 107*a* toward the portion extending into the collection chamber 60. The end 107*c* of the horizontal pipe 107 is largely extended to the inside of the collection chamber 60, to thus pass through the partition 50*a* between the central chamber 90 and the collection chamber 60 and to be inserted into the dust filter bag 61.

An opening 61*a* is formed in the dust filter bag 61 so that the horizontal suction pipe 107 can be inserted thereinto. A surrounding guide ring 62 formed of a firm material so that the horizontal suction pipe 107 remains stably inserted into the dust filter bag 61 is installed around the hole 61*a*.

In the vacuum cleaner according to the present invention having the above structure, when the fan motor assembly 71 in the apparatus chamber 70 operates, extraneous matter in the space where the suction head 55 is located is sucked into the dust filter bag 61 through the first suction port 51 by the suction force generated by the operation of the fan motor assembly 71.

The air, out of which extraneous matter is filtered while passing through the dust filter bag 61, passes through the fan motor assembly 71 and is discharged through the discharge channels 54*a*, 54*b*, 54*c*, and 54*d*.

When the cover 102 on the top of the case 50 is opened, the air around the vacuum cleaner is sucked into the collection chamber 60 through the second suction port 52 and the peripheral air suction device 100, is purified while passing through the dust filter bag 61, and is discharged to the outside of case 50 through the apparatus chamber 70 and the discharge channels 54*a*, 54*b*, 54*c*, and 54*d*.

Some of the air discharged from the fan motor assembly 71 is ejected into the horizontal suction pipe 107 of the peripheral air suction device 100 through the ejector pipe 110 at high speed and low pressure.

Therefore, the pressure in the horizontal suction pipe 107 becomes lower. Accordingly, dust that floats in the air around the vacuum cleaner, caused by air discharged from the case 50, can be smoothly sucked in through the second suction port 52 of the case 50.

The air and dust sucked in through the second suction port 52 are sucked into the dust filter bag 61 through the suction net 101, the suction guide 103, the vertical suction pipe 105, and the horizontal suction pipe 107. The dust sucked into the dust filter bag 61 is filtered by the dust filter bag 61. Only the purified air passes through the dust filter bag 61 and is discharged to the outside of the case 50 through the fan motor assembly 71 and the discharge channels 54*a*, 54*b*, 54*c*, and 54*d*.

In the above embodiment, the second suction port 52 connected to the peripheral air suction device 100 is installed on the top of the case 50. However, the second suction port 52 can be formed on the side, in the hind part, or on the bottom of the case 50.

Figure 6:
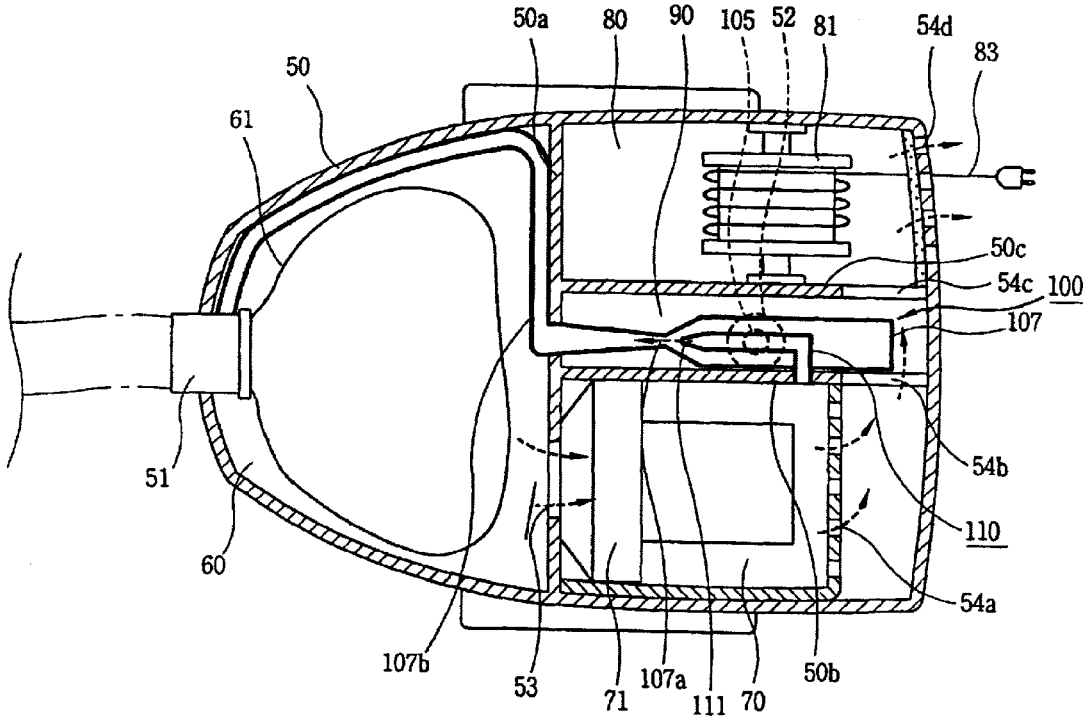
FIG. 6 is a cross sectional view of the vacuum cleaner, similar to FIG. 4, but illustrating an end of a horizontal suction pipe of the peripheral air purifying apparatus being directly connected to a first suction port.

Also, the horizontal suction pipe 107 of the peripheral air suction device 100 is directly inserted into the dust filter bag 61. However, the end of the peripheral air suction device 100 can be directly connected to the first suction port 51, as illustrated in FIG. 6.

In this case, a conventional dust filter bag 61, in which only the part connected to the first suction port 51 is opened, can be used without forming an additional opening 61*a* in the dust filter bag 61.

The vacuum cleaner according to the present invention having the above structure and operation is formed so that the dust that floats in the air around the vacuum cleaner, caused by air discharged from the vacuum cleaner, is sucked into the case through the peripheral air suction device and is purified. Therefore, it is possible to reduce the inconvenience of the user and to improve the cleaning efficiency by sucking up even the dust that floats in the air around the cleaned area.

What is claimed is:

1. A vacuum cleaner, comprising:

a case having a collection chamber including a filter for removing extraneous matter mixed with air sucked in through main suction channels in the case and an apparatus chamber including a fan motor assembly for generating suction force and discharging intake air behind the collection chamber; and a peripheral air suction means connected between an external surface of the case and the main suction channels or between the external surface of the case and the inside of the collection chamber in addition to the main suction channels, the peripheral air suction means sucking up the air around the case.

2. The vacuum cleaner of claim 1, wherein the area of a channel of the peripheral air suction means is formed to be smaller than the areas of the main suction channels.

3. The vacuum cleaner of claim 1, wherein the peripheral air suction means is connected to the inside of the filter of the collection chamber.

4. The vacuum cleaner of claim 1, further comprising an ejector connected between a discharge area of the fan motor assembly and the inside of the peripheral air suction means, the ejector ejecting some of the air discharged from the fan motor assembly into the peripheral air suction means.

5. The vacuum cleaner of claim 4, wherein an orifice, whose area is relatively reduced at a portion where an end of the ejector is located, is formed in the peripheral air suction means.

6. The vacuum cleaner of claim 4, wherein the ejector includes a nozzle at an end thereof located in the peripheral air suction means.

7. The vacuum cleaner of claim 1, wherein a suction port connected to the peripheral air suction means is formed in the top of the case.

8. The vacuum cleaner of claim 7, wherein the suction port includes a cover means for opening and closing the peripheral air suction means.

9. The vacuum cleaner of claim 7, wherein the suction port includes a suction net through which materials larger than a certain size cannot pass.

10. The vacuum cleaner of claim 7, wherein the peripheral air suction means comprises:

a suction guide decreasing in diameter from the suction port toward the inside of the vacuum cleaner;

a vertical suction pipe connected to the suction guide and extending toward the inside of the vacuum cleaner; and a horizontal suction pipe connected between the end of the vertical suction pipe and the inside of the collection chamber.

11. The vacuum cleaner of claim 10, wherein the horizontal suction pipe includes an ejector connected between the discharge area of the fan motor assembly and the inside of the horizontal suction pipe, the ejector ejecting air discharged from the fan motor assembly into the horizontal suction pipe, thus strengthening a suction force therein.

12. The vacuum cleaner of claim 1, wherein the filter includes an opening through which extraneous matter can be sucked in from the peripheral air suction means.

13. The vacuum cleaner of claim 1, wherein the case comprises the collection chamber in a front part thereof, and the apparatus chamber and a cord chamber in which a power cord is stored in a hind part thereof, separated from the collection chamber by a partition;

and wherein the peripheral air suction means is installed in a space separated by two partitions between the apparatus chamber and the cord chamber.

* * * * *